US005885190A

United States Patent [19]

Reiter

[11] Patent Number: 5,885,190

[45] Date of Patent: Mar. 23, 1999

[54] SUSPENDED EXERCISE DEVICE

[76] Inventor: Rupert Reiter, Alpenstrasse 58, A-5020 Salzburg, Austria

[21] Appl. No.: 913,582

[22] PCT Filed: Mar. 15, 1996

[86] PCT No.: PCT/AT96/00049

§ 371 Date: Sep. 18, 1997

§ 102(e) Date: Sep. 18, 1997

[87] PCT Pub. No.: WO96/30086

PCT Pub. Date: Oct. 3, 1996

[30] Foreign Application Priority Data

| | | | |
|---|---|---|---|
| Mar. 27, 1995 | [AT] | Austria | 548/95 |
| May 29, 1995 | [AT] | Austria | 894/95 |
| Oct. 2, 1995 | [AT] | Austria | 1619/95 |

[51] Int. Cl.[6] ..... A63B 21/02

[52] U.S. Cl. ..... 482/69; 482/907; 482/96; 482/124

[58] Field of Search ..... 482/124, 126, 482/129, 102, 122, 907, 121–130, 904; 248/188.7; 601/35, 34, 33

[56] References Cited

U.S. PATENT DOCUMENTS

| | | | |
|---|---|---|---|
| D. 144,582 | 4/1946 | Rassnick | 482/129 |
| 1,585,748 | 5/1926 | Wendelken | 482/129 |
| 2,625,202 | 1/1953 | Richardson et al. | 482/69 |
| 3,677,543 | 7/1972 | Richardson | 482/129 |
| 4,779,867 | 10/1988 | Hinds | 482/126 |
| 5,399,139 | 3/1995 | Malynowsky | 482/129 |
| 5,514,059 | 5/1996 | Romney | 482/124 |

*Primary Examiner*—Jerome Donnelly
*Attorney, Agent, or Firm*—Lorusso & Loud

[57] ABSTRACT

A suspended trimming device in which two lengths of cable are suspended from a yoke and have loops at their ends, in which the yoke is suspended to pivot at least about a horizontal axis. According to the invention, the yoke is suspended on an elastic cable secured to the yoke at its longitudinal center so that the yoke is vertically movable and can also rotate about a vertical axis.

19 Claims, 3 Drawing Sheets

SUSPENDED EXERCISE DEVICE

Figure 1:
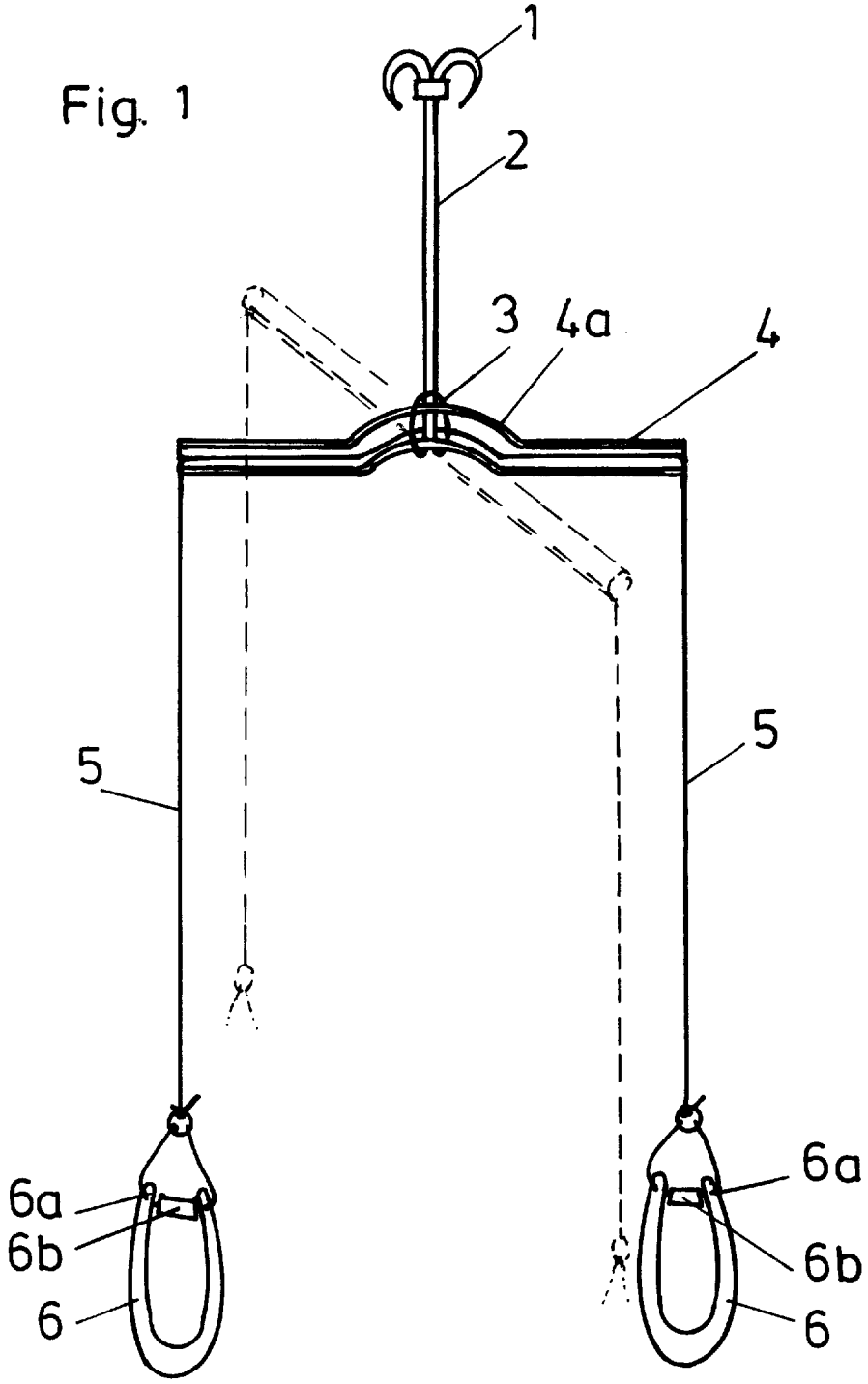

The invention relates to a hanging keep-fit apparatus in which two cable portions hang down from a cross bar, at the ends of each of which cable portions is provided a respective loop, wherein the cross bar is suspended pivotably at least about a horizontal axis.

A hanging keep-fit apparatus of that kind is already known from German patent specification No. 141 129. In that known apparatus the cross bar which is horizontal in the rest position is mounted pivotably about a horizontal pivot pin. Fixed to each of the ends of the cross bar is a respective cable portion which hangs down and which at the bottom has a loop for the person doing exercise.

The object of the invention is to improve a hanging keep-fit apparatus of the general kind set forth in the opening part of this specification and to enlarge the possible forms of movement for the person using the hanging keep-fit apparatus.

In accordance with the invention that is achieved in that the cross bar is suspended on at least one elastic cable which is preferably fixed at the longitudinal center to the cross bar.

The configuration according to the invention provides that the cross bar on the one hand is movable against the spring force of the elastic cable and in addition can rotate about a vertical axis. Accordingly the cross bar can assume practically any position in space, whereby the hanging keep-fit apparatus is very suitable for motion or kinetic training, for strengthening the muscles and joints with little application of force due to the lift action of the cross bar. The hanging keep-fit apparatus can be used in a lying or sitting position, also standing at the cross bar. Hands or feet are put into the loops, whereby it is possible to perform the most widely varying movement training exercises such as for example straddle vaulting, cycling, swinging up and down or backwards and forwards or blobbing up and down or bouncing for stress relief purposes. The cross bar itself can be used standing with the hands for stretching and pulling exercises.

It is advantageously provided that the cross bar is in the form of a cross bar tube through which—as is known per se—a cable is passed in one piece, the cable portions of which hang down at the respective ends of the cross bar tube. Passing a cable in one piece through a kind of cross bar is known per se from WO88/08730 A1 and U.S. Pat. No. 3,301,555 A. The equipment shown in the last-mentioned specification is a piece of play equipment for children, in which cables are passed through a horizontal beam member around guide rollers. In that arrangement the cable portions do not issue from the ends of the beam member but laterally, which requires a more expensive structure. The apparatus shown in WO88/08730 A1 also does not have a simple cross bar tube in accordance with the invention. Rather, the arrangement has a cross bar which is fixed horizontally to the ceiling and in the interior of which extend curved guides for a cable. The configuration according to the invention provides that one and the same person can hold the loops at the end of both cable portions of the cable which is guided in one piece, and move the cable in opposite directions through the cross bar tube if, in accordance with a further preferred embodiment, the cable is guided by the movable tube. In the event of the cable being immovably guided through the cross bar tube, that arrangement still affords the advantage that specific fixings are not required for the two cable portions, but the cable can simply be passed through the cross bar tube.

A simple and stable fixing of the elastic cable to the cross bar is possible by virtue of the elastic cable being passed around the cross bar and knotted fast thereto by means of a knot. In that case it is particularly advantageous if the knot is prevented from slipping laterally by a screw or hook which is screwed into the cross bar. The cables can also be fixed in the tube of the cross bar with the screwed-in hook or screw at the knot.

A further embodiment is characterized in that the elastic cable is in the form of a preferably double-run or double-strand rubber cable. A double-run rubber cable of that kind has a higher level of stability and can be easily fixed to the cross bar by a simple loop knot or slip knot which is laid around the cross bar. In addition, the use of a double-run rubber cable affords a certain basic orientation for the cross bar which it automatically adopts again after the cable portions are released.

A lateral slipping movement can be prevented and the adoption of an in particular horizontal basic orientation of the cross bar can also be achieved by the cross bar having a curve portion in the region of its longitudinal center.

The loop at the end of the cable portions can either be formed directly thereon. It is however also possible for each cable portion to be passed through a separate first loop, in which case the cable portion itself forms a second loop. A separate loop of that kind may comprise for example plastic material and may offer a larger support for parts of the body, such as for example arms or legs. The cable portion itself can then be used as a second loop, in which respect it is desirable if the part of the cable portion which lies within the separate first loop is reinforced by a tube portion which is fitted thereover.

For easily fixing the entire hanging keep-fit apparatus it can be provided that a fixing element, preferably a hook or snap hook or carbineer, is provided at the upper end of the elastic cable.

A further embodiment provides that disposed on the cross bar or the knot of the elastic cable carrying the cross bar is a cable pulley over which—as is known per se—is passed an additional cable which has a respective loop at each of its free ends. In that case it is particularly advantageous if the additional cable is adjustable in respect of its length in order to permit adaptation to the respective user.

Cable pulleys with cables passed therearound are already known per se for exercise purposes, for example from German patent specification No 425 012, U.S. Pat. No. 3,979,114, German laid-open application (DE-OS) No. 15 78 629, U.S. Pat. No. 4,060,240 or German published specification (DE-AS) No. 17 28 633. In that case however the cable pulleys are suspended non-elastically for example on a door frame. It is only in combination with the cross bar which is suspended by way of an elastic cable, together with the cable portions hanging thereon, that it is possible to perform numerous physiotherapy exercises in which in particular also turning or somersaulting movements can be performed. By virtue of the additional provision of an additional cable which is passed around a cable pulley, the lever action of the cross bar means that it is also possible for a weakened leg also to be easily moved for strengthening purposes.

With that configuration it is for example also possible to use the two loops of the additional cable for supporting and lifting the knee of the user, in which case the user suspends his feet in the loops of that cable which is fixed to the elastically suspended cross bar. In that case those loops can advantageously be provided with a foot clamping means in order to hold the foot fitted into the loop in the loop, in which case the foot clamping means may be of such a design configuration that it contracts automatically when the loop is loaded by the weight of the foot. That is possible for example by the foot clamping means comprising a piece of cable which at the first end has a knob, which from there is passed outwardly through the loop, and which is passed from the outside inwardly through the loop again, in which case the piece of cable is guided in the same manner on the opposite side of the loop and finally has a knob at the second end.

Embodiments of the hanging keep-fit apparatus according to the invention are described in greater detail in the following specific description.

Figure 2:
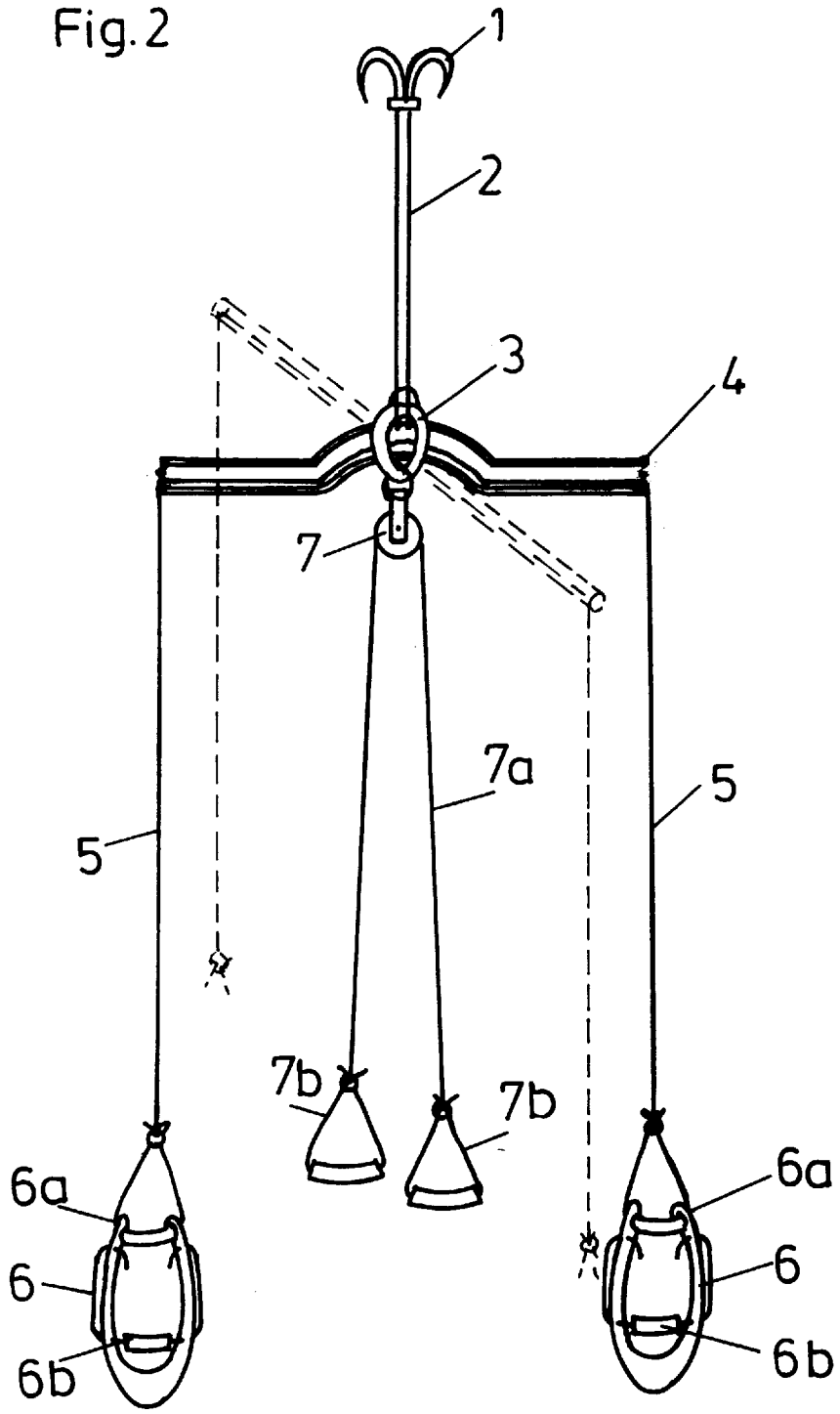
Figure 3:
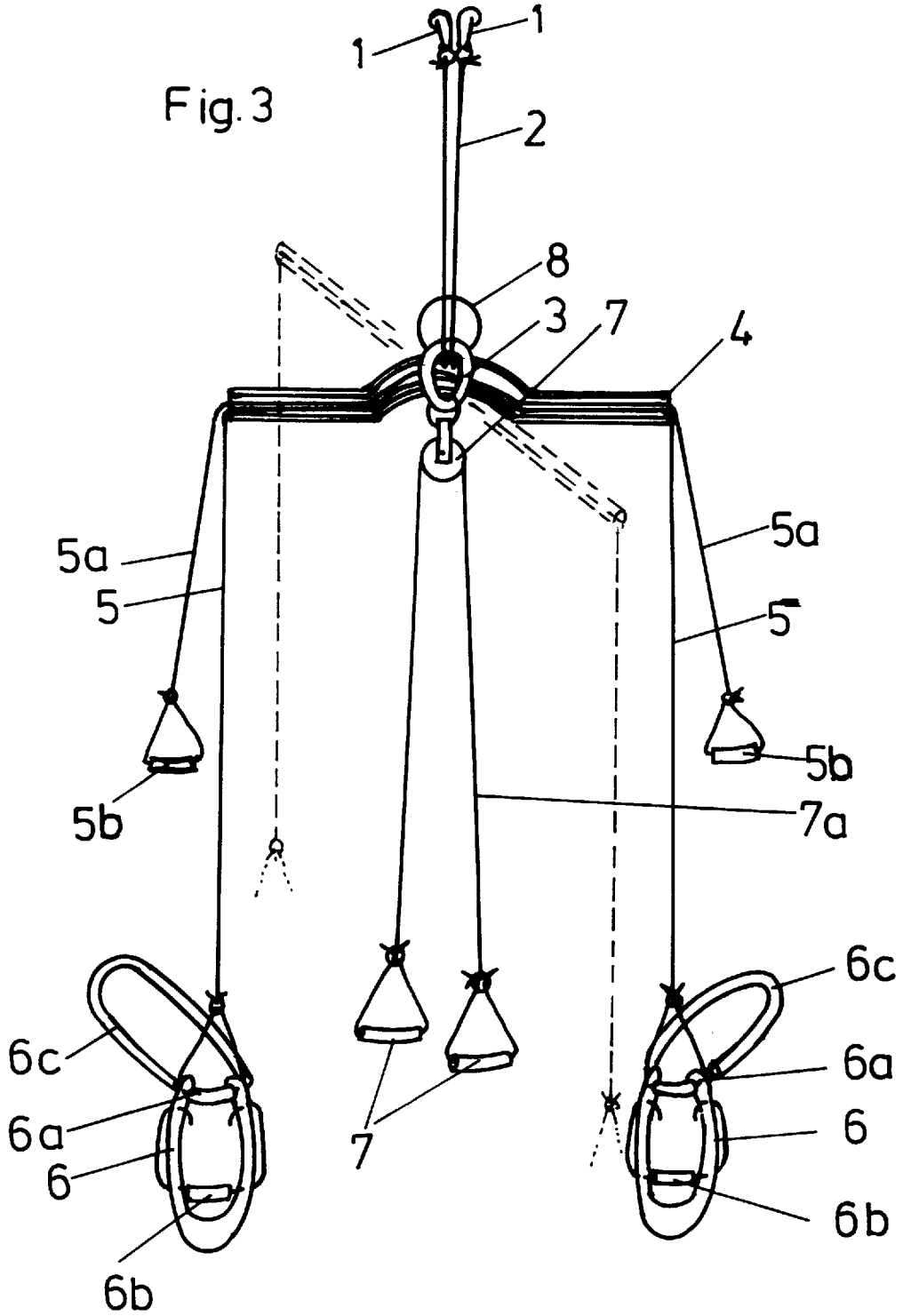

FIGS. 1 to 3 show diagrammatic front views of three different alternative configurations.

The hanging keep-fit apparatus shown in FIG. 1 can be suspended with a fixing element 1, for example a hook or snap-hook or carbineer, either from the ceiling, from the head beam member of the door frame or on a raised bed end structure or a horse. According to the invention the cross bar 4 which is horizontal in the rest position is suspended on an elastic rubber cable 2 which is of a double-run nature and which is advantageously connected to the cross bar 4 by way of a simple loop knot, at the longitudinal center of the cross bar 4. A curve portion 4*a* in the cross bar ensures that it adopts a substantially horizontal rest position (solid lines in FIG. 1; in use the cross bar can pivot, for example into the position shown in broken line), when a pulling force is not applied to the loops 6 at the end of the cable portions 5. In addition the curve portion 4*a* reduces the risk of the knot 3 slipping sideways. That danger can be further reduced by screwing in a small screw or hook (not shown) into the cross bar 4 in the region of the knot 3.

The cable or cable portions 5 are advantageously passed in one piece through the cross bar 4 which is in the form of a cross bar tube, with the cable portions 5 each hanging down from the respective ends of the cross bar tube. Arranged at the end of each cable portion 5 is a separate, first large loop 6 through which is passed a second small loop 6*a* of the cable portion 5. Within the first loop 6 the part of the cable portion 5 disposed there is reinforced by a tube portion 6*b* which is pushed thereover. For physiotherapy purposes the large loop can be provided doubled and can thus be used to support the ankles and/or the elbow.

In the embodiment shown in FIG. 2 suspended from the knot 3 is a cable pulley 7 about which is passed a displace able additional cable 7*a* which has two loops 7*b* at its ends. The loops 7*b* can also be provided with cushioning tubes.

The loops 6 have a foot clip or clamping means which essentially comprises a piece of cable 6*b*. The piece of cable 6*b* has a knot at a first end and from there extends outwardly through the material of the loop 6, from there downwardly and then through the material of the loop into the interior of the loop again. The piece of cable is guided symmetrically on the opposite side and again terminates in a knob. If a part of the body which is fitted into the large loop 6, for example a foot, is loaded downwardly, the piece of cable 6*b* holds that part of the body fast in the loop 6.

The apparatus shown in FIG. 2 can be used for example for physiotherapy purposes in which the user passes his legs through the loops 7*b* until they are arranged in the region of the backs of the knees. The feet can then be put into the loops 6. Exercises such as straddling, cycling, turning and swinging can then be performed in all directions, in the lying or sitting position.

Stretching and pulling exercises can also be done standing with the pivotal cross bar 4. By virtue of the provision of the elastic cable, exercises from the lying to the sitting and bending position can be easily performed over a long period to strengthen and tighten the stomach and back muscles.

In the case of disablement of both legs the two legs can each be fitted into respective additional large loops 6*c* (FIG. 3). The additional loops 6*c* can be longer and narrower, they serve not only as support loops for hands and feet, they can also be used as pulling loops for better bending the knees. The feet however are supported in the loops with the foot clamping means 6*b*. By way of additional cable portions 5*a* which hang down from the cross bar 4, the cross bar 4 can be pivoted or rotated with the hands, whereupon the legs which are supported in the loops 6*b* also perform that movement. The additional cable portions 5*a* have loops 5*b* at their free ends, for engagement with the hands. It is thus also possible for exercises to be performed from a wheelchair.

In addition, in the embodiment shown in FIG. 3, a ring 8 is fixed to the knot 3 of the elastic rubber cable 2. The carbineer hook 1 at the free end of the elastic rubber cable (double-run cable) can be fitted into that ring 8, in which case there is formed a loop which in turn can be suspended for example from a hook which is disposed on the ceiling. That provides overall for suspension of the cross bar by way of four parallel cables 2 which, in contrast to the two cables shown in FIG. 3, have overall a higher spring constant. That stabilization effect by virtue of a lower overall spring action on the part of the quadruple rubber cable is advantageous in particular in relation to exercises from a wheelchair.

It is further possible that all cables are adjustable, that a hook which is screwed in on the cross bar 4 prevents the rubber cable 2 from slipping off, that the single large loop 6 can be provided in duplicate (but without foot clamping means) for physiotherapy exercises, that a cushioning tube is included on the cable of the foot clamping means, that the cable pulley 7 can be disposed both on the cross bar 4 and also on the knot 3, and that it is advantageous if a knot 3 can be provided and that it is advantageous if a carbineer hook is disposed therebetween for hanging the cable pulley on and taking it off.

I claim:

1. A suspended exercise device comprising:

a cross bar having a first end and a second end;

an elastic cable attached to the cross bar and adapted for suspending the cross bar and to allow horizontal movement of the cross bar when the elastic cable is suspended vertically;

a second cable supported by the cross bar and having a first hanging portion at one end and a second hanging portion at the other end, the first hanging portion extending from the first end of the cross bar and having a first loop at a free end, the second hanging portion extending from the second end of the cross bar and having a second loop at a free end;

a cable pulley mounted to the cross bar;

a third cable having a third loop at one end and a fourth loop at the other end, wherein a portion of the third cable between the third loop and the fourth loop passes over the cable pulley;

the cables, loops and pulley arranged so that a person wishing to exercise can put his hands or feet in one or more of the loops to exercise when the cross bar is suspended by the elastic cable.

2. The suspended exercise device of claim 1 wherein the cross bar is a tube and the second cable extends through the tube in one piece.

3. The suspended exercise device of claim 1 wherein the first cable is movable within the tube.

4. The suspended exercise device of claim 1 further comprising a knot formed by passing the elastic cable around the cross bar and tying it to the cross bar.

5. The suspended exercise device of claim 4 further comprising a hook attached to the cross bar to prevent the knot from slipping laterally.

6. The suspended exercise device of claim 1 wherein the elastic cable is a double-run rubber cable.

7. The suspended exercise device of claim 1 wherein the cross bar is curved in a region of its longitudinal center.

8. The suspended exercise device of claim 1 wherein a piece of the first hanging portion of the second cable forms the first loop and another piece of the first hanging portion of the second cable passes through a fifth loop, and a piece of the second hanging portion of the second cable forms the second loop and another piece of the second hanging portion passes through a sixth loop.

9. The suspended exercise device as set forth in claim 8 further comprising two reinforcing tube portions, one fitted over a portion of the first hanging portion of the second cable which is within a fifth loop, and the other fitted over a portion of the second hanging portion of the second cable which is within a sixth loop.

10. The suspended exercise device of claim 8 further comprising an attachment element positioned at an upper end of the elastic cable.

11. The suspended exercise device of claim 8 wherein the third cable has an adjustable length.

12. The suspended exercise device of claim 1 further comprising two foot clampers, one arranged on the first loop and the other arranged on the second loop.

13. The suspended exercise device of claim 12 wherein the foot damper arranged on the first loop comprises a fourth cable having a knot at a first end, the fourth cable passing from the knot outwardly through the first loop, then passing from outside inwardly again through the first loop, then passing in the same manner on an opposite side of the first loop, and terminating in a knob at its other end, and the foot damper arranged on the second loop comprises a fifth cable having a knot at a first end, the fifth cable passing from the knot outwardly through the second loop, then passing from outside inwardly again through the second loop, then passing in the same manner on an oppose side of the second loop, and terminating in a knob at its other end.

14. The suspended exercise device as set forth in claim 1 further comprising a seventh loop at an end of the first hanging portion of the second cable, and an eighth loop at an end of the second hanging portion of the second cable.

15. The suspended exercise device as set forth in claim 1 wherein a portion of the third cable extends down from the cross bar beside the first hanging portion of the second cable, and a portion of the third cable extends down from the cross bar beside the second hanging portion of the second cable.

16. The suspended exercise device of claim 1 further comprising a ring attached to the cross bar.

17. The suspended exercise device of claim 10 further comprising a ring attached to the knot.

18. The suspended exercise device of claim 10 wherein the attachment element is a hook.

19. The suspended exercise device of claim 10 wherein the attachment element is a carabiner.

* * * * *